US010562029B2

(12) United States Patent
Zinober et al.

(10) Patent No.: US 10,562,029 B2
(45) Date of Patent: Feb. 18, 2020

(54) REAGENT PRE-STORAGE HAVING DEFINED EXTRACTION

(71) Applicant: Robert Bosch GmbH, Stuttgart (DE)

(72) Inventors: Sven Zinober, Friolzheim (DE); Yvonne Beyl, Zaberfeld (DE); Daniel Czurratis, Korntal-Muenchingen (DE)

(73) Assignee: Robert Bosch GmbH, Stuttgart (DE)

( * ) Notice: Subject to any disclaimer, the term of this patent is extended or adjusted under 35 U.S.C. 154(b) by 127 days.

(21) Appl. No.: 15/503,332

(22) PCT Filed: Aug. 7, 2015

(86) PCT No.: PCT/EP2015/068255
§ 371 (c)(1),
(2) Date: Feb. 10, 2017

(87) PCT Pub. No.: WO2016/026718
PCT Pub. Date: Feb. 25, 2016

(65) Prior Publication Data

US 2017/0225168 A1 Aug. 10, 2017

(30) Foreign Application Priority Data

Aug. 19, 2014 (DE) ..... 10 2014 216 391

(51) Int. Cl.
*B01L 3/00* (2006.01)
*B01F 13/00* (2006.01)

(52) U.S. Cl.
CPC ..... *B01L 3/523* (2013.01); *B01L 3/502738* (2013.01); *B01F 13/0059* (2013.01);
(Continued)

(58) Field of Classification Search
CPC ..... B01L 3/523; B01L 3/502738; B01L 2200/16; B01L 2300/044; B01L 2300/049;
(Continued)

(56) References Cited

U.S. PATENT DOCUMENTS 6,082,185 A 7/2000 Saaski
7,980,272 B2 * 7/2011 Park ..... F16K 99/0001 137/828
(Continued)

FOREIGN PATENT DOCUMENTS

CN 102105227 A 6/2011
CN 102112229 A 6/2011
(Continued)

OTHER PUBLICATIONS

International Search Report corresponding to PCT Application No. PCT/EP2015/068255, dated Nov. 20, 2015 (German and English language document) (5 pages).

*Primary Examiner* — Jill A Warden
*Assistant Examiner* — Jacqueline Brazin
(74) *Attorney, Agent, or Firm* — Maginot, Moore & Beck LLP

(57) ABSTRACT

An apparatus, in particular a microfluid apparatus, includes a chamber for extracting a fluid. The chamber has a wall with an opening. The opening is sealed by a sealing mechanism that is impermeable to specified substances. The apparatus further includes a membrane that contacts the outside of the wall, in a region of an outside of the wall which adjoins the opening, and covers the opening.

17 Claims, 9 Drawing Sheets

(52) U.S. Cl.
CPC ..... *B01L 2200/16* (2013.01); *B01L 2300/044* (2013.01); *B01L 2300/049* (2013.01); *B01L 2400/0638* (2013.01); *B01L 2400/0655* (2013.01); *B01L 2400/0677* (2013.01); *B01L 2400/0683* (2013.01)

(58) Field of Classification Search
CPC ..... B01L 2400/0638; B01L 2400/0655; B01L 2400/0677; B01L 2400/0683; B01F 13/0059
USPC ..... 422/547
See application file for complete search history.

(56) References Cited

U.S. PATENT DOCUMENTS

| | | | | |
|---|---|---|---|---|
| 2003/0013205 | A1* | 1/2003 | Konrad | B01L 3/50825 436/177 |
| 2006/0166233 | A1 | 7/2006 | Wu et al. | |
| 2013/0034869 | A1* | 2/2013 | Whitesides | B01L 3/502738 435/7.92 |
| 2014/0255275 | A1* | 9/2014 | Barry | B01L 3/502715 422/547 |

FOREIGN PATENT DOCUMENTS

| | | | |
|---|---|---|---|
| CN | 102633226 | A | 8/2012 |
| CN | 103380299 | A | 10/2013 |

* cited by examiner

REAGENT PRE-STORAGE HAVING DEFINED EXTRACTION

This application is a 35 U.S.C. § 371 National Stage Application of PCT/EP2015/068255, filed on Aug. 7, 2015, which claims the benefit of priority to Serial No. DE 10 2014 216 391.9, filed on Aug. 19, 2014 in Germany, the disclosures of which are incorporated herein by reference in their entirety.

BACKGROUND

In microfluidics, reagents have to be pre-stored for later use for a relatively long period of time. These reagents are generally pre-stored in chambers prepared specifically therefor, with inlets and outlets of the chambers having to be sealed in a fluid-tight manner. U.S. Pat. No. 7,980,272 B2 discloses, for example, a microfluidic apparatus having a sample chamber, wherein the opening into the chamber is closed with a material removable by heating.

SUMMARY

The disclosure relates to a device, in particular a microfluidic device, having a chamber for receiving a fluid, wherein the chamber comprises a wall having an opening, and wherein the opening is closed with a closure means impermeable to predefined substances. The predefined substances are present here preferably in fluid form or are dissolved in a fluid. According to the disclosure, the device comprises a membrane, wherein, in a region of an outer side of the wall which adjoins the opening, the membrane bears against the outer side of the wall and covers the opening.

The disclosure therefore provides an advantageous device which, by means of the closure means impermeable to predefined substances, allows for said substances to be pre-stored with long-term stability. In addition, uncontrolled opening of the chamber is prevented when removing the closure means from the opening. In particular, the disclosure prevents uncontrolled escape of the predefined substances, of the pre-stored fluid and/or of the closure means from the chamber and allows for a defined removal of the fluid by way of a, preferably controlled, displacement of the membrane over the opening.

The closure means can be removed in particular by preceding, at least partial heating of the closure means. In this respect, a connection between a first part of the closure means and a part of a boundary of the opening and/or between a first part of the closure means and a second part of the closure means is detached. After at least part of the closure means has been detached, the detached part can be removed from the opening.

In an advantageous development of the disclosure, the device comprises a fluid duct, which extends at least partially between the outer side of the wall and the membrane in such a manner that, in the event of a predefined displacement of a first portion of the membrane over the opening, in particular into a first receiving region, the fluid duct is fluidically connected to the opening. It is thereby advantageously possible to discharge the pre-stored substances from the chamber via the fluid duct as desired and in predefined quantities by displacement of the membrane after the removal of at least part of the closure means.

In a particularly advantageous development of the disclosure, the device comprises a second receiving region adjoining that side of the membrane which is remote from the opening. The second receiving region in this respect has a minimum size in order, in the event of a predefined expansion of the first portion or of a second portion of the membrane over the opening into the first receiving region, to receive the detached part of the closure means in the first receiving region together with the first portion or with the second portion of the membrane. This has the advantage that the detached part of the closure means is conveyed into a region outside the chamber and therefore does not hinder the removal of the pre-stored substances upon emptying of the chamber. The first receiving region and the second receiving region can overlap one another partially or completely or can also be spatially separated from one another at least partially by a delimitation.

According to a preferred development of the disclosure, the first receiving region and/or the second receiving region comprises a pneumatic access for setting a negative pressure in the first receiving region or in the second receiving region. The pneumatic access therefore allows for the displacement of the first portion or of the second portion of the membrane into the first receiving region or into the second receiving region by the negative pressure set. By way of example, the pneumatic access is an opening or a valve in a wall delimiting the first or second receiving region. The pneumatic access is preferably coupled to a pump for generating the negative pressure in the first receiving region or in the second receiving region, wherein the pump can be part of the device according to the disclosure and/or is connected for example via a fluid-tight line to the respective pneumatic access.

The device preferably comprises a layer adjoining that side of the membrane which is remote from the opening, wherein the layer comprises the first receiving region and/or the second receiving region in the form of a cutout.

It is particularly preferable that the second receiving region comprises a constriction, such that a partial region of the second receiving region which is located downstream of the constriction in relation to the membrane has the minimum size for receiving the first portion or the second portion of the membrane and the detached part of the closure means. This constriction makes it difficult for the received part of the closure means to move back in the direction of the opening of the wall and to thereby hinder removal of the predefined substances from the chamber.

The opening preferably has a predefined shape for targeted discharge of the detached part of the closure means from the opening. The predefined shape advantageously assists a movement of the detached part in a preferred direction, for example in the direction of the first receiving region. In particular, the opening in the wall of the chamber can have a width which increases or decreases in the direction of the outer side of the wall. The widening or reduction can be configured here in the form of a cone, a truncated pyramid or a truncated tetrahedron.

In a particularly advantageous development of the disclosure, the chamber is filled with a fluid, wherein the fluid has a higher or a lower density than the closure means, such that, during the at least partial removal of the closure means from the opening, the part of the closure means rises into a top region of the device in relation to the direction of gravity or sinks into a bottom region of the device in relation to the direction of gravity. This advantageously has the effect that the detached part of the closure means is discharged from a region directly around the opening by the buoyancy in the fluid, and therefore does not block or clog up the opening for removal of the fluid or the substances from the chamber.

The closure means preferably comprises paraffin. Paraffin is particularly suitable for sealing in microfluidics, since it is inert with respect to many chemicals and insoluble and also harmless to health. A further advantage consists in the fact that paraffin has a low melting point and therefore promotes the removal of part of the closure means by way of heating. By choosing the composition of the paraffin from different alkanes, it is possible here to set the melting point of the paraffin.

The closure means preferably comprises metals or metal compounds for inductive heating. Since microfluidic devices are for the most part constructed from electrically non-conductive materials, heating of the closure means by way of electromagnetic induction is particularly advantageous.

Closure means which are located in the interior of a microfluidic device and are therefore accessible to heat radiation from the outside only with difficulty can therefore also be heated in a simple way without an area surrounding the closure means being heated excessively.

In an advantageous embodiment of the disclosure, the closure means comprises predefined substances, wherein the substances have a degree of absorption of greater than 0.8, preferably greater than 0.9, for electromagnetic radiation with a wavelength of between 780 and 3000 nm, preferably between 900 and 1100 nm. The use of soot particles in the closure means is particularly advantageous in this respect.

In an advantageous embodiment of the disclosure, the chamber at least partially has an inner coating comprising a material impermeable to predefined substances. This promotes the storage of the substances with long-term stability and prevents contamination of the microfluidic system by diffusion of the substances through walls of the chamber. The inner coating preferably comprises a paraffin, metal layers comprising aluminum, aluminum oxide, platinum, silver, gold, silicon dioxide layers and/or plasma-polymerized hexamethyldisiloxane layers.

The disclosure also relates to a method for removing a fluid from a device according to the disclosure. The method comprises, in a first step, detaching, in particular by heating the closure means, at least part of the closure means from the opening of the chamber. A second step involves displacing the first portion of the membrane over the opening, in particular into the first receiving region, in order to fluidically connect the fluid duct to the opening. A third step involves removing at least some of the fluid received in the chamber.

In an advantageous development of the method according to the disclosure, before the expansion of the first portion of the membrane, the first portion or the second portion of the membrane is displaced into the second receiving region, in order to receive the detached part of the closure means together with the first portion or with the second portion of the membrane in the second receiving region.

The disclosure furthermore also relates to a method for producing a device according to the disclosure. The production method comprises, in a first step, connecting a first substrate, which comprises the chamber for receiving the fluid having the opening, to the membrane, such that the membrane bears against a first side of the substrate and covers the opening. A second step involves connecting the membrane to the layer which comprises the first and/or the second receiving region for receiving the displacing first portion of the membrane as a recess by way of that side of the membrane which is remote from the opening. A third step involves closing the opening by means of a dispenser which has the closure means and is introduced into the chamber via an at least partially open side of the substrate. A fourth step involves sealing the at least partially open side of the substrate with a sealing film.

BRIEF DESCRIPTION OF THE DRAWINGS

Exemplary embodiments of the disclosure are illustrated in the drawings and explained in more detail in the description hereinbelow. The same reference signs are used for the similarly acting elements illustrated in the various figures, with a repeated description of the elements being dispensed with.

In the drawings.

DETAILED DESCRIPTION

Figure 1A:
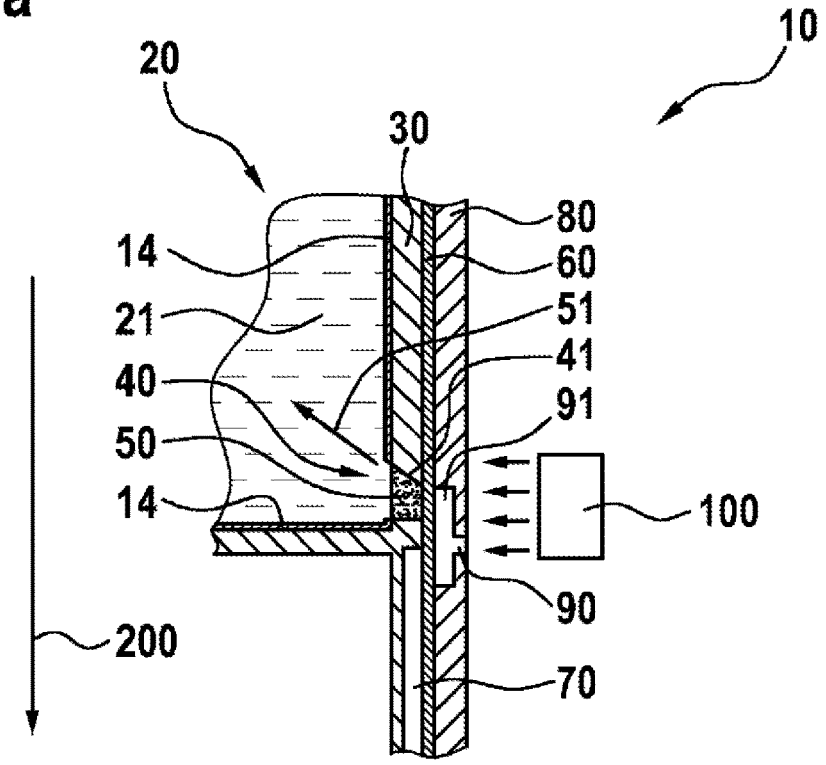
FIGS. 1*a* to *c* show a device according to the disclosure in a first embodiment.

FIG. 1 shows part of a device 10 according to the disclosure, which comprises a chamber 20 for receiving a fluid 21. The chamber 20 is delimited on one side by a wall 30, wherein the chamber 20 comprises an opening 40 which is closed with a closure means 50 impermeable to predefined substances. Furthermore, the device 10 comprises a membrane 60, wherein, in a region of an outer side of the wall 30 which adjoins the opening 40, the membrane 60 bears against the outer side of the wall 30 and covers the opening 40. On account of the coverage of the opening 40 by the membrane 60, at least an immediate escape of the fluid 21 from the chamber 20 is prevented upon removal of the closure means 50, even if the membrane 60 is not completely steam-impermeable to the substances present in the fluid 21. A situation in which parts of the closure means 50 can escape from the chamber 20 upon detachment of the closure means 50 from the opening 40 is furthermore prevented. It is optionally possible for a coating 14 to be applied to inner sides of walls of the chamber 20, said coating preventing a diffusion of substances from the fluid 21 through the walls of the chambers and therefore promoting storage of the fluid 21 with long-term stability.

Suitable materials for walls of the chamber 20 are in particular thermoplastics, for example polycarbonates (PC), polypropylene (PP), polyethylene (PE), polymethyl methacrylate (PMMA) or cyclic olefin copolymers (COC, COP), with a preferred thickness of 0.5 to 5 mm. The membrane 60 can be configured as a polymer membrane having a thickness of 0.005 to 0.3 mm and can comprise, for example, an elastomer, a thermoplastic elastomer, a thermoplastic or a hotmelt adhesive film. By way of example, the volume of the chamber 20 is between 0.005 and 50 ml. The optional coating 14 can comprise paraffin, metal layers comprising aluminum, aluminum oxide, platinum, silver, gold, silicon dioxide layers and/or plasma-polymerized hexamethyldisiloxane layers.

The closure means 50 can comprise soft or hard paraffins with melting or solidification points which can be predefined by a selection of the alkane composition, as a result of which it is possible in a simple manner to remove the closure means 50 from the opening 40 by heating the closure means 50 by means of a heat source 100 arranged in the vicinity of the opening 40. Heating of the paraffin-containing closure means 50 above the solidification point of the paraffin used has the effect, through the melting which sets in, of softening and therefore disengaging the closure means 50 from the opening 40.

The heat source 100 for heating part or all of the closure means 50 can comprise an external heating element, for example a laser, or else a heating element embedded in the device 10 according to the disclosure, for example a heating resistor integrated close to the closure means 50.

The closure means 50 can also comprise metals or metal compounds, such that the closure means 50 can be heated by way of electromagnetic induction. For uniform heating, the closure means 50 can contain a structure made of metal. As an alternative or in addition, the closure means 50 can also comprise substances having a high degree of absorption for electromagnetic radiation in a predefined wavelength range, in order to promote quick and efficient heating of the closure means 50. Suitable in this respect are in particular soot particles embedded in the paraffin.

Figure 1B:
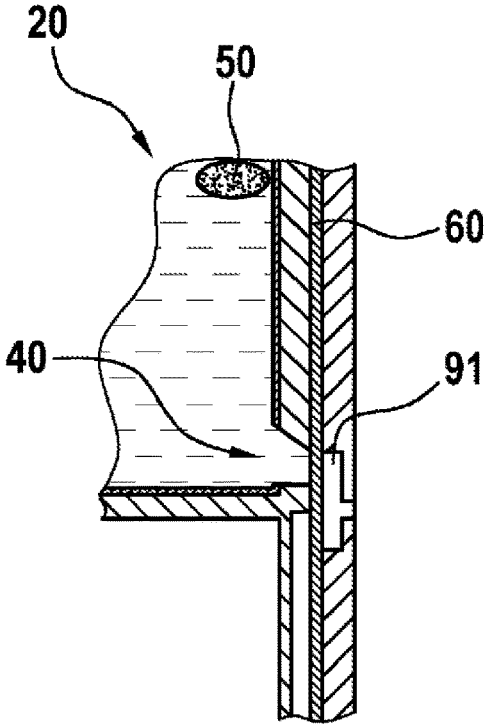

FIG. 1*b* shows the device according to the disclosure shown in FIG. 1*a*, wherein the closure means 50 has been removed from the opening 40. The closure means 50 advantageously has a lower density than the fluid 21 stored in the chamber 20, such that the closure means 50 has risen into a top region of the chamber 20 in relation to the direction 200 of gravity, and therefore exposes the opening 40. Since the membrane 60 covers the opening 40, escape of the fluid 21 from the chamber 20 is prevented. By displacing a first part 61 of the membrane 60 over the opening 40, brought about for example by applying a negative pressure in a region around the first part 61 of the membrane 60, the fluid 21 can subsequently be removed from the chamber 20 in well-defined quantities owing to the known size of the opening 40. Even those fluids for which inexpensive membrane materials are not completely functionally dense or steam-impermeable can be stored with long-term stability owing to the advantageous combination of a closure means 50 impermeable to the received fluid 21 with an adjacent membrane 60.

Figure 1C:
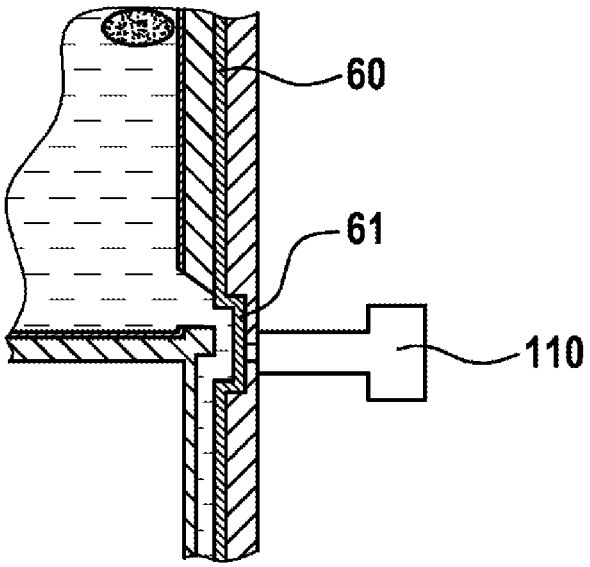

In the exemplary embodiment shown in FIGS. 1*a* to 1*c*, the device 10 according to the disclosure further comprises a fluid duct 70, which extends at least partially between the outer side of the wall 30 and the membrane 60 in such a manner that, in the event of a predefined displacement of a first portion 61 of the membrane 60 over the opening 40, the fluid duct 70 is fluidically connected to the opening 40. The first portion 61 of the membrane 60 can be displaced in this respect by way of the application of a negative pressure. In order to limit the displacement of the membrane 60 over the opening 40 to the first portion 61 of the membrane, the device 10 according to the disclosure comprises a layer 80, which layer adjoins that side of the membrane 60 which is remote from the opening 40 and which layer comprises a first receiving region 91 for receiving the displacing first portion 61 of the membrane 60. As an alternative or in addition, the membrane 60 can be connected to the wall 60 and/or the layer 80 adjoining the membrane at those locations at which displacement of the membrane 60 is not desired. A negative pressure for displacing the first portion 61 of the membrane 60 can be applied by way of a pneumatic access 90 in the form of a first through-opening 90 in the layer 80 to the first receiving region 91. In this respect, the through-opening 90, as shown in FIG. 1*b*, can be connected to a pump 110, for example. As can likewise be seen from FIG. 1*c*, after displacement of the first portion 61 of the membrane 60 into the first receiving region 91, the fluid 21 located in the chamber 20 can be removed via the fluid duct 70.

In order to promote the discharge of the closure means 50 from the opening 40 upon removal of the closure means 50 from the opening 40, the embodiment of the device 10 according to the disclosure which is illustrated in FIGS. 1*a* to 1*c* optionally has a predefined shape of the opening 40. The predefined shape of the opening 40 is characterized by a width of the opening 40 which decreases in the direction of the outer side of the wall 30. Furthermore, the opening 40 is delimited by a first surface 41, wherein the first surface 41 is inclined in relation to the direction 200 of the acting buoyancy and/or gravity in the case of an orientation of the apparatus which is predefined for the operation of the apparatus. The angle enclosed in this case by the surface normal of the first surface 41 and the direction of the acting buoyancy and/or gravity is greater than 0° and less than 180°, and is preferably between 30° and 60°, very preferably approximately 45°. The opening 40 can be shaped in particular in such a manner that the closure means 50 which is located therein and which completely fills the opening has the shape of a cone, a truncated pyramid or a truncated tetrahedron. Such a surface 41 of the opening 40 inclined in this way, in cooperation with the buoyancy and/or gravity, predefines a preferred direction 51 for the discharge of the detached closure means 50. If the closure means 50 has been liquefied by heating, the inclined first surface 41 brings about a resulting buoyancy in the direction of the interior of the chamber 20 for the closure means 50 flowing away. If the closure means 50 has only been softened by heating, but the shape thereof has not been changed, the decreasing width of the 40 prevents the escape of the softened closure means 50 from the chamber. Furthermore, the buoyancy resulting at the inclined first surface 41 brings about targeted discharge of the closure means 50 from the opening 40 into the interior of the chamber 20.

As an alternative, it is also possible for the opening 40 to have a width which increases in the direction of the outer side of the wall 30. This has the advantageous effect that, in the event of detachment of the connection between the closure means 50 and the opening 40, the closure means 50 is initially prevented from moving into the chamber 20 and remains in the opening 40. After displacement of the first portion 61 of the membrane 60, the closure means 50 can be discharged from the opening 40 via the fluid duct 70.

Figure 2A:
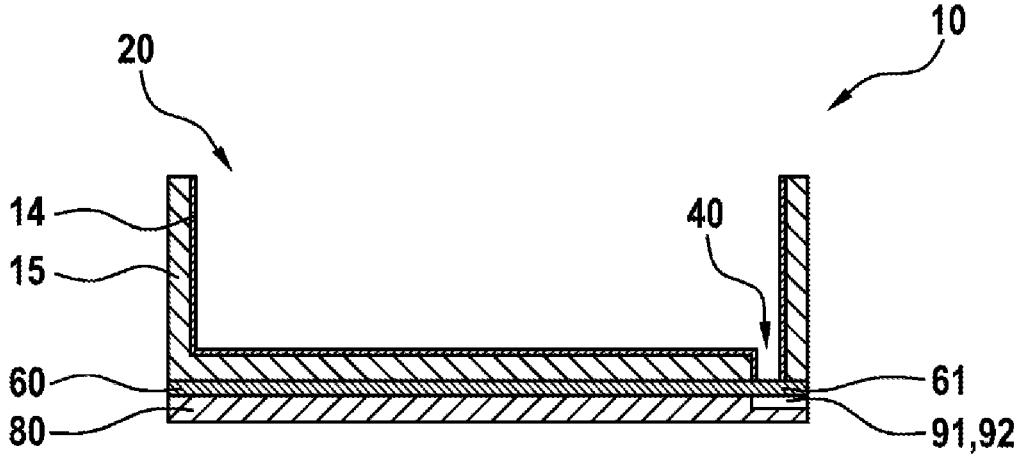
FIGS. 2*a* to *d* show a method for producing the device according to the disclosure as a polymeric multi-layer structure.
Figure 2B:
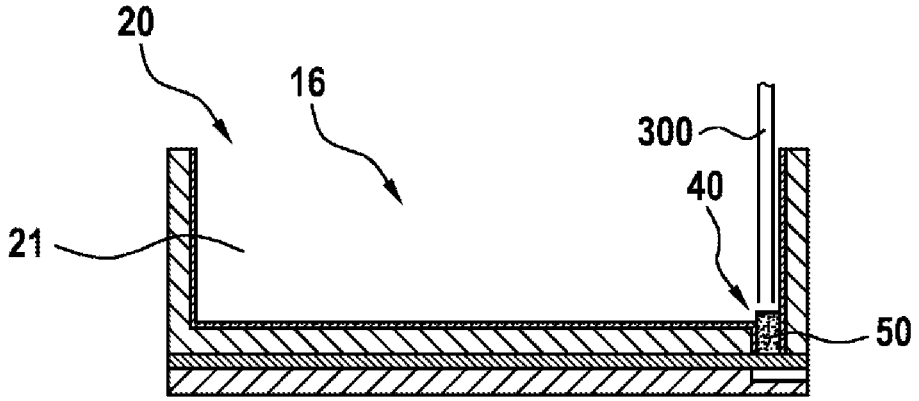
Figure 2C:
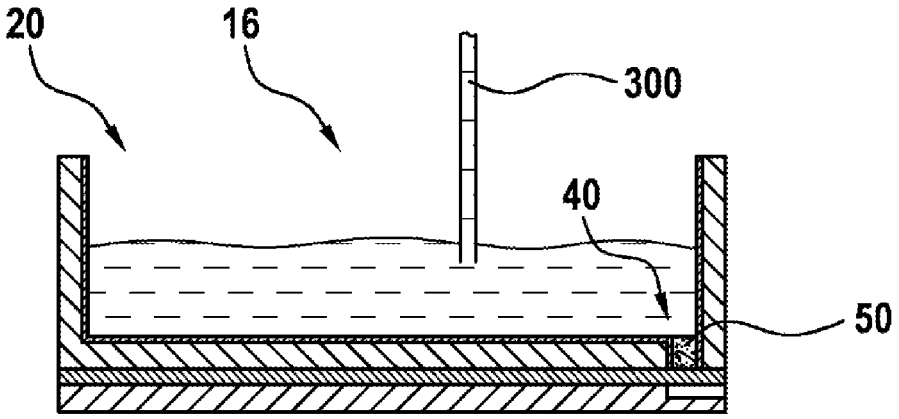
Figure 2D:
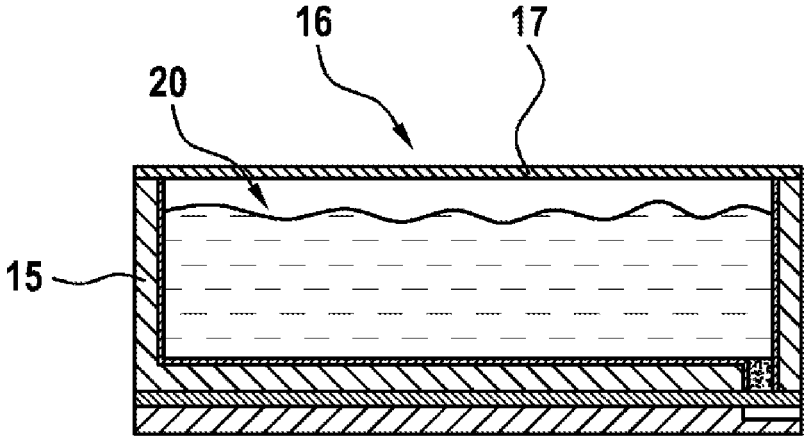

FIGS. 2*a* to 2*d* show a method for producing the device 10 according to the disclosure as a polymeric multi-layer structure. As shown in FIG. 2*a*, the device 10 is produced by connecting a first substrate 15, which comprises the chamber 20 in the form of a recess having the opening 40, to the flexible membrane 60, such that the membrane 60 bears against a first side of the substrate 15 and covers the opening 40, and by connecting the membrane 60 to the layer 80 by way of that side of the membrane 60 which is remote from the opening 40. The layer 80 in this case comprises a receiving region 91, 92 for receiving the displacing first portion 61 of the membrane 60 as a recess. After the substrate 15 has been connected to the membrane 60, the inner sides of the walls of the chamber 20 can be provided with the coating 14 for storage of the fluid 21 with long-term stability via an at least partially open second side 16. FIG. 2*b* shows how the opening 40 is closed with the closure means 50 with the aid of a dispenser 300 introduced into the chamber 20 via the at least partially open second side 16, before, as illustrated in FIG. 2*c*, the chamber 20 is filled with the fluid 21 via the dispenser 300. Finally, FIG. 2*d* shows how the open side 16 of the substrate 15 and therefore the chamber 20 is sealed in a fluid-tight manner by adhesive bonding or fusion with a sealing film 17, for example a polymer composite film or a polymer sheet.

Figure 3A:
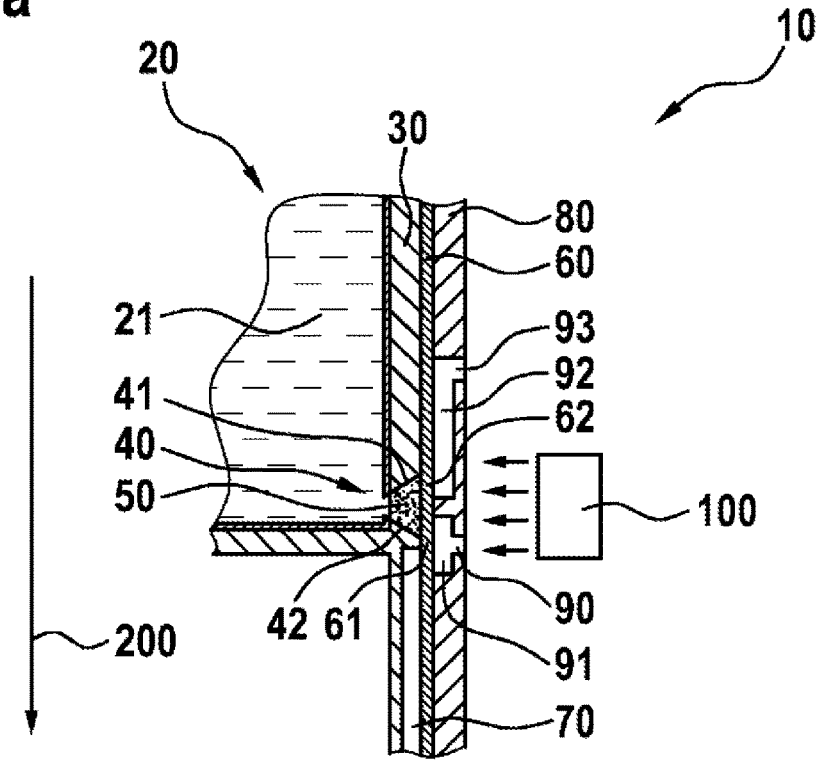
FIGS. 3*a* to *c* show an advantageous development of the first embodiment shown in FIGS. 1*a* to *c*, FIGS. 4*a* to *c* show an advantageous development of the embodiment shown in FIGS. 3*a* to *c*.
Figure 3B:
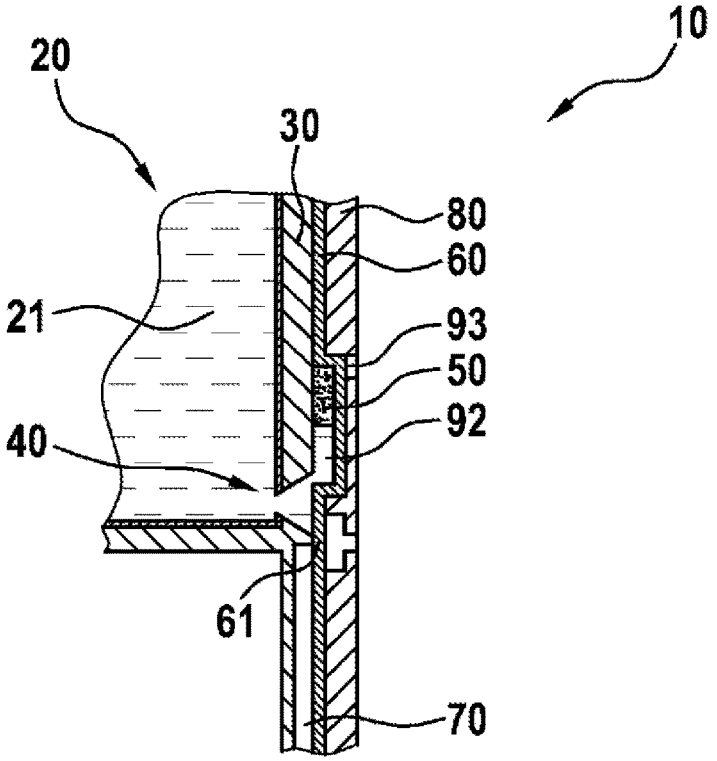
Figure 3C:
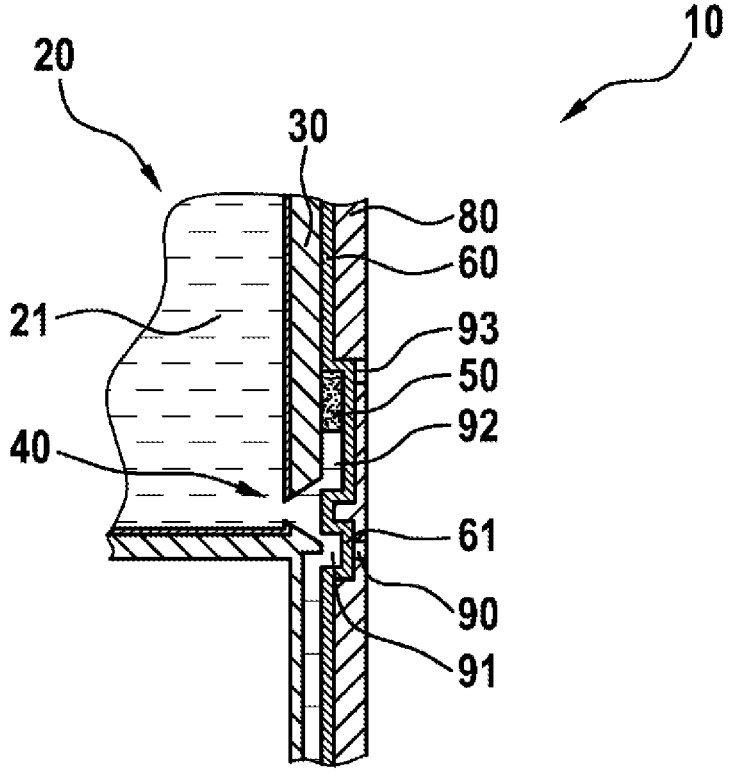

FIGS. 3*a* to 3*c* show a development of the device 10 according to the disclosure on the basis of the embodiment shown in FIGS. 1*a* to 1*c*. The development differs from the embodiment shown in FIGS. 1*a* to 1*c* by an opening 40, wherein the opening 40 has a width which increases in the direction of the outer side of the wall 30. In addition to the first surface 41, the increasing width is defined by a second surface 42 delimiting the opening 40, wherein the first surface 41 and the second surface 42 are inclined in relation to the direction 200 of the acting buoyancy and/or gravity in the case of an orientation of the apparatus which is predefined for the operation of the apparatus. The angle enclosed in this case by the surface normals of the first surface 41 and the second surface 42 and the direction of the acting buoyancy and/or gravity is greater than 0° and less than 180°, and is preferably between 30° and 60°, very preferably approximately 45°. On account of the inclined second surface 42 delimiting the opening 40 from below and the inclined surface 41 delimiting the opening 40 from above, the opening 40 therefore has a width which increases in the direction of the outer side of the wall 30. The inclination of the first and of the second surface 41, 42, in cooperation with the buoyancy in the fluid 21, promotes the sliding away or flowing away of the softened or molten closure means 50 along the first and second surface 41, 42 in the direction of the outer side of the wall 30. Furthermore, the membrane 60 comprises a second portion 62, wherein the first portion 61 of the membrane 60 can be displaced into the first receiving region 91 of the layer 80 and the second portion 62 can be displaced into a second receiving region 92 of the layer 80. A negative pressure for displacing the second portion 62 of the membrane 60 can be applied by way of a further pneumatic access 93 in the form of a second through-opening 93 in the layer 80 to the second receiving region 92. The second receiving region 92 has a minimum size for receiving the removed closure means 50 together with the second portion 62 upon displacement of the second portion 62 into the second receiving region 92. In a manner corresponding to the exemplary embodiment shown in FIGS. 1*a* to 1*c*, the fluid duct 70 is fluidically connected to the opening 40 by way of displacement of the first portion 61 of the membrane 60. The removal of the fluid 21 from the chamber 20 can therefore proceed in two steps. In a first step, which is shown in FIGS. 3*a* and *b*, the closure means 50 is heated by way of the heat source 100 and received by displacement of the second portion 62 of the membrane 60 into the second receiving region 92. In a second step, a fluidic connection is established between the chamber 20 and the fluid duct 70 by displacement of the first portion 61 of the membrane 60 into the first receiving region 91.

Figure 4A:
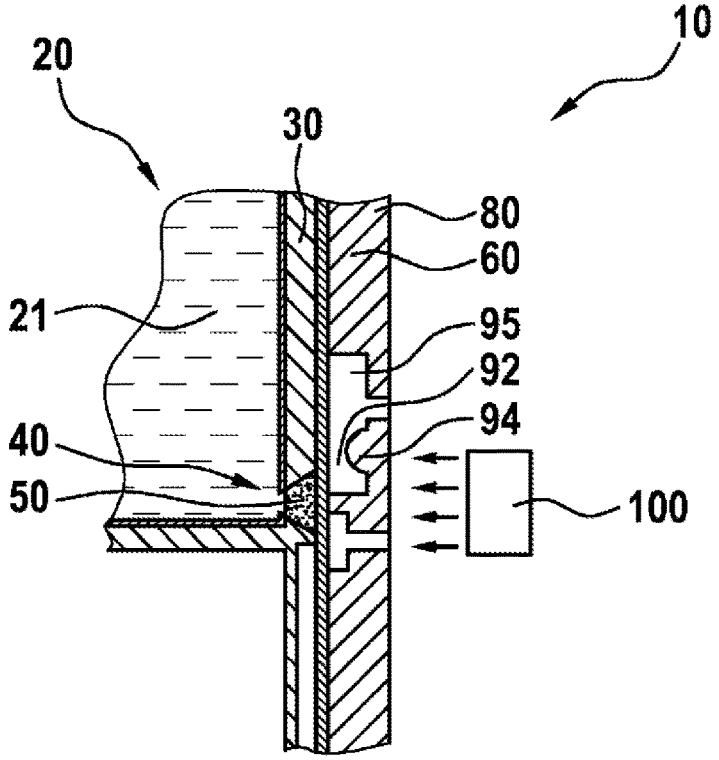
Figure 4B:
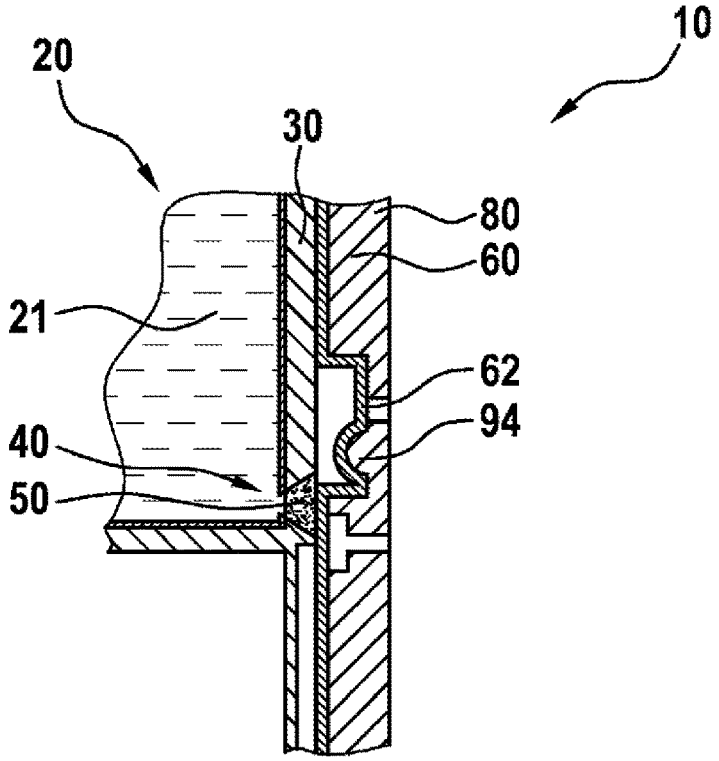
Figure 4C:
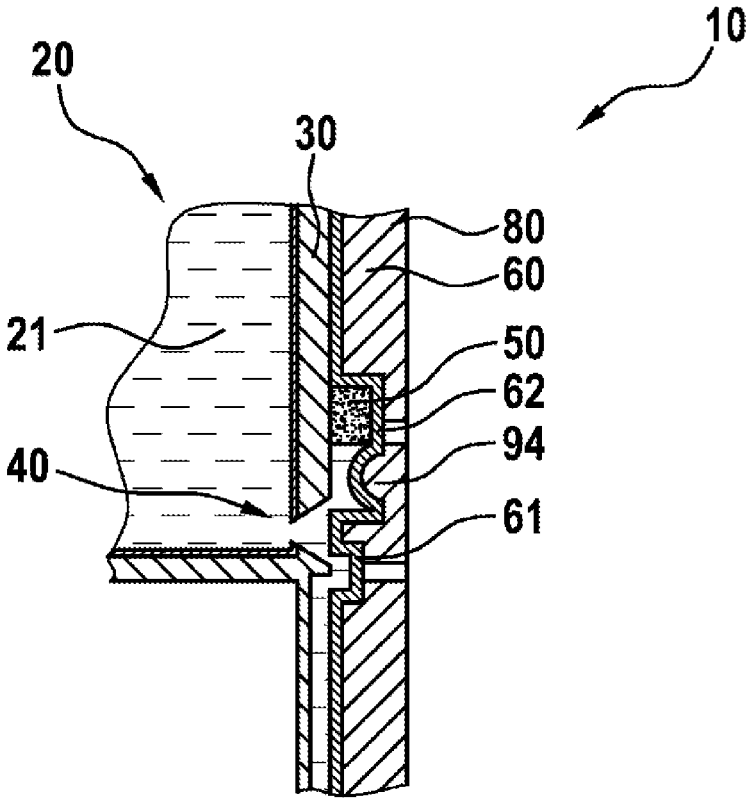

FIGS. 4*a* to 4*c* show a development of the exemplary embodiment of the device 10 according to the disclosure which is illustrated in FIGS. 3*a* to 3*c*. In this development, the second receiving region 92 of the layer 80 comprises a constriction 94, wherein the constriction 94 is arranged in the recess 92 in such a manner that a partial region 95 of the second receiving region 92 which is located downstream of the constriction 94 in relation to the membrane 60 has a minimum size for receiving the second portion 62 of the membrane 60 together with the removed closure means 50. This has the advantage that, in the event of a displacement of the second portion 62 into the partial region 95 of the second recess 92, and after the received softened or molten closure means 50 has been solidified, a movement of the solidified closure means 50 back into a region close to the opening 40 is made more difficult or even prevented by the constriction 94.

Figure 5:
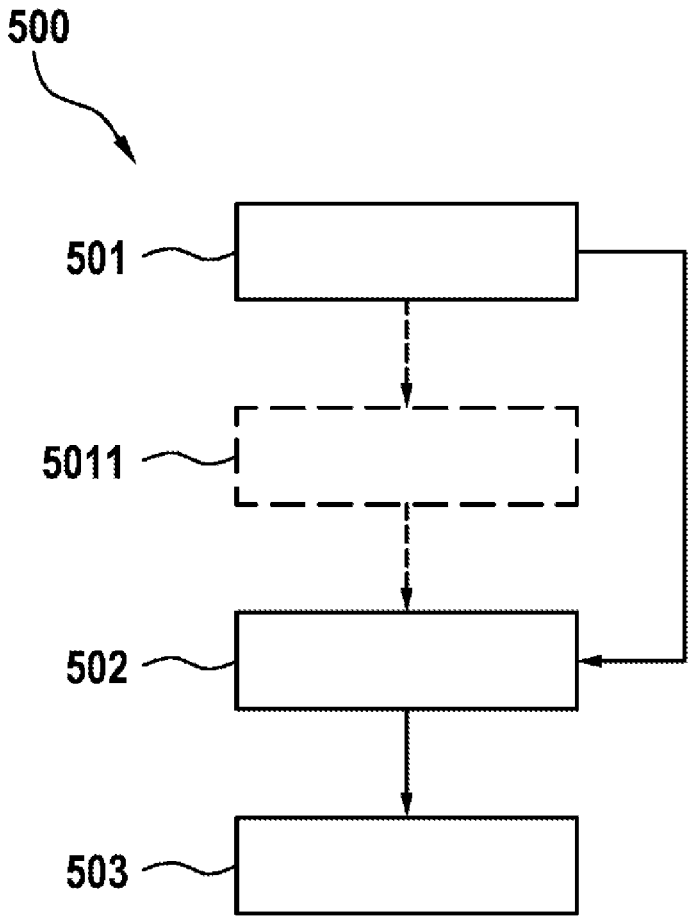
FIG. 5 shows a method according to the disclosure for removing a fluid from a device according to the disclosure.

FIG. 5 shows an exemplary embodiment of the method 500 according to the disclosure for removing a fluid 21 from the chamber 20 of the device 10 according to the disclosure. In a first step 501, at least part of the closure means 50 is detached from the opening 40 by heating and removed. In a second step 502, the first portion 61 of the membrane 60 is displaced over the opening 40 in order to fluidically connect the fluid duct 70 to the opening 40. In a third step 503, at least some of the fluid 21 received in the chamber 20 is removed. Optionally, in an intermediate step 5011 carried out before the second step 502, it is possible for the second portion 62 of the membrane 60 to be displaced into the second receiving region 92, in order to receive the removed closure means together with the second portion 62 of the membrane 60 in the second receiving region 92.

The invention claimed is:

1. A device comprising:

a chamber configured to receive a fluid, the chamber defined at least in part by a wall with an opening to the chamber therethrough that is closed with a closure device which adjoins the opening and is impermeable to predefined substances; and a membrane which is positioned outside of the chamber, and which, in a region of an outer side of the wall, adjoins the opening, bears against the outer side of the wall, and covers the opening, wherein the device comprises a fluid duct that extends at least partially between the outer side of the wall and the membrane in such a manner that, in the event of a predefined displacement of a first portion of the membrane over the opening into a first receiving region, the fluid duct is fluidically connected to the opening.

2. The device as claimed in claim 1, wherein the device comprises a second receiving region adjoining that side of the membrane which is remote from the opening, and wherein the second receiving region has a minimum size in order, in the event of a predefined displacement of the first portion of the membrane or of a second portion of the membrane over the opening into the second receiving region, to receive a part of the closure device which has been detached from the opening by heating of the closure device, together with the first portion or the second portion of the membrane.

3. The device as claimed in claim 2, wherein one or more of the first receiving region and the second receiving region comprises a pneumatic access configured to set a negative pressure in the first receiving region or in the second receiving region in order to cause the displacement of the first portion or of the second portion of the membrane into the first receiving region or into the second receiving region by the negative pressure set.

4. The device as claimed in claim 2, wherein the device comprises a layer adjoining that side of the membrane which is remote from the opening, and wherein the layer comprises one or more of the first receiving region and the second receiving region in the form of a cutout.

5. The device as claimed in claim 2, wherein the second receiving region comprises a constriction such that a partial region of the second receiving region which is located downstream of the constriction in relation to the membrane has the minimum size configured to receive the first portion or the second portion of the membrane and the detached part of the closure device.

6. The device as claimed in claim 1, wherein the opening has a predefined shape for targeted discharge of the detached part of the closure device from the opening.

7. The device as claimed in claim 6, wherein the predefined shape is configured by a width of the opening which increases or decreases in the direction of the outer side of the wall.

8. The device as claimed in claim 1, wherein the chamber is filled with a fluid and the fluid has a higher or a lower density than the closure device such that the detached part of the closure device rises into a top region of the device in relation to the direction of gravity or sinks into a bottom region of the device in relation to the direction of gravity.

9. The device as claimed in claim 1, wherein the closure device comprises paraffin.

10. The device as claimed in claim 1, wherein the closure device comprises metals or metal compounds for inductive heating.

11. The device as claimed in claim 1, wherein the closure device comprises predefined substances, and wherein the substances have a degree of absorption of greater than 0.8 for electromagnetic radiation with a wavelength of between 780 and 3000 nm.

12. The device as claimed in claim 1, wherein the chamber at least partially has an inner coating comprising a material impermeable to predefined substances.

13. A method for removing a fluid from a microfluidic chamber, the chamber defined at least in part by a wall with an opening to the chamber therethrough that is closed with a closure device which adjoins the opening and is impermeable to predefined substances, the method comprising:

detaching at least part of the closure device from the opening by heating the closure device, displacing a first portion of a membrane which is positioned outside of the chamber and which is bearing against an outer side of the wall and covering the opening into a first receiving region in order to fluidically connect a fluid duct extending at least partially between the outer side of the wall and the membrane to the opening, and removing at least some of the fluid received in the chamber via the opening and the fluid duct.

14. The method as claimed in claim 13, wherein, before the displacement of the first portion of the membrane, a displacement of a second portion of the membrane into a second receiving region adjoining that side of the membrane which is remote from the opening is effected in order to receive the detached part of the closure device together with the second portion of the membrane in the second receiving region.

15. A method for producing a microfluidic device comprising a chamber configured to receive a fluid, the method comprising:

connecting a first substrate, which comprises the chamber configured to receive the fluid having an opening, to a membrane such that the membrane bears against a first side of the substrate and covers the opening, connecting the membrane to a layer by way of that side of the membrane which is remote from the opening, wherein the layer comprises a receiving region configured to receive a displacing portion of the membrane as a recess, closing the opening by a dispenser which has a closure device and is introduced into the chamber via an at least partially open second side of the substrate, sealing the at least partially open second side of the substrate with a sealing film.

16. The device as claimed in claim 1, wherein the device is configured as a microfluidic device.

17. The device as claimed in claim 11, wherein the predefined substances have a degree of absorption of greater than 0.9 for electromagnetic radiation with a wavelength of between 900 and 1100 nm.

* * * * *